US005202087A

United States Patent [19]

Culling

[11] Patent Number: 5,202,087

[45] Date of Patent: Apr. 13, 1993

[54] CEMENT COOLER GRATE ALLOY

[75] Inventor: John H. Culling, St. Louis, Mo.

[73] Assignee: The Carondelet Corporation, Pevely, Mo.

[21] Appl. No.: 922,824

[22] Filed: Jul. 31, 1992

[51] Int. Cl.[5] ..... C22C 38/36

[52] U.S. Cl. ..... 420/17; 420/12

[58] Field of Search ..... 420/17, 12, 50, 55; 148/324

[56] References Cited

U.S. PATENT DOCUMENTS 2,422,948 6/1947 Cape ..... 420/17
5,106,577 4/1992 Fesler ..... 420/12

FOREIGN PATENT DOCUMENTS 58-193343 11/1983 Japan ..... 420/12
779427 11/1980 U.S.S.R. ..... 420/17

*Primary Examiner*—Deborah Yee

*Attorney, Agent, or Firm*—Senniger, Powers, Leavitt & Roedel

[57] ABSTRACT

Alloys are provided which consist essentially of:

| | |
|---|---|
| CHROMIUM | 11-20% By Weight |
| NICKEL | 3-10.5% |
| MOLYBDENUM | 1-4% |
| CARBON | 2-4.5% |
| NITROGEN | Up to about 0.25% |
| SILICON | 2.7-4% |
| COPPER | Up to about 4% |
| COBALT | Up to about 4% |
| MANGANESE | Up to about 4% |
| ALUMINUM | Up to about 0.2% Maximum |
| COPPER + COBALT | Up to 4% Total |
| COPPER + COBALT + MANGANESE | Up to 8% Total |
| IRON & IMPURITIES | Essentially Balance |
| provided that NICKEL + COPPER + COBALT is | 6-12.5% |
| and further provided that NICKEL + COPPER + COBALT + MANGANESE is | 6-15% |

8 Claims, No Drawings

CEMENT COOLER GRATE ALLOY

FIELD OF THE INVENTION

This invention relates to low cost heat and abrasion resistant alloys suitable for use in cement cooler grates. The alloys can be air melted and cast.

BACKGROUND OF THE INVENTION

In the manufacture of portland cement huge tonnages of low cost alloy grates are employed in the cooling of the cement clinker that is discharged from the rotary kilns. These grates ordinarily operate at temperatures in the region of 1200° to 1400° F. but may occasionally reach temperatures as high as 1500° to 1600° F. They are subject to corrosive attack and to surface wear by constant contact with the highly abrasive clinker.

Fesler, U.S. Pat. No. 5,106,577, discloses low cost, air meltable and castable alloys for this service. The '577 alloys have given outstanding service and have been produced by employing a wide variety of scraps and other return metallic parts and stocks. However, the '577 grate alloys include in their formulation about 0.25 to 1.5% by weight of aluminum. The inclusion of aluminum has presented manufacturing problems in the production of the cast grates because aluminum is readily oxidized at alloy melting and pouring temperatures. Further because of its low density, aluminum cannot simply be added to the molten metal during air melting in the same manner that other alloy components are handled. Therefore, in the foundry the other ingredients of the melt have been added to the furnace and brought to the molten state, but the aluminum additions have been postponed until the last. When the melt is otherwise complete, the aluminum has been added as solid lumps attached to the end of steel rods and held below the surface of the molten bath until completely melted. Alternatively, aluminum has sometimes been added in lump form to the surface of the molten metal as a ferro-aluminum, which is typically composed of about 35% Al and the balance substantially iron.

By either method, the final aluminum content in the melt is hard to control. It is possible to conduct a spectrographic analysis of the molten metal prior to pouring, then to make a further corrective addition of aluminum, if this preliminary test discloses a low content of the element. However, this procedure is not desirable because of the production delay involved and because the aluminum content may deteriorate somewhat during the holding period while an analysis is being conducted due to the additional time of contact with air. In addition, recycled scraps, sprues, gates, risers and returns of used castings from the field are widely employed in the production of cooler grates. The melting loss of aluminum from these materials is difficult to predict. Thus, aluminum recovery is inconsistent when using returns as well new materials additions during alloy preparation.

Another problem which arise from the use of aluminum is that the aluminum oxide that forms on the surface of the molten metal cannot be entirely skimmed or removed prior to pouring the castings in the foundry and this persistent oxide scum tends to be carried into the mold cavity and result in some lap and seam defects or discontinuities in solid shapes. Further, there appears to be some segregation taking place during the melting and casting procedures such that the aluminum content is often not consistent from casting to casting or, sometimes, even within an individual casting.

A potentially very severe problem in foundry production of high aluminum content alloys is that some of the frozen spillage, gates, risers or returns may accidentally be introduced into piles of materials intended for other alloys. There are many alloys in which a small amount of aluminum results in excessive brittleness. This defect has been termed "rock candy" structure due to the appearance of the coarse grain observed upon fracture of castings made from such alloys.

For all of these reasons, despite the excellent results in the field of the '577 alloys, it has remained desirable to find substitute, similar alloys, which do not include high aluminum content.

The Fesler patent also discloses the desirability of employing high carbon contents along with molybdenum to provide alloys of about 400 to 480 Brinell Hardness Number (BHN) at room temperature with resultant hot hardnesses of about 230 to 270 BHN at 1300° F. For this purpose carbon contents of about 2 to 4.5%, preferably 2.8 to 4%, and molybdenum contents of about 1 to 4%, preferably 2 to 3%, have served remarkably well. Fesler also discloses a number of high silicon alloys that have proven to be far too brittle for even this low impact application.

I have now found the desirable properties of the alloys made in accordance with the '577 patent may be achieved by formulating almost the same base alloys without including any substantial amount of aluminum provided that the silicon content is greater than that employed in the Fesler alloys and falls within the range of about 2.7% to 4% by weight.

SUMMARY OF THE INVENTION

It is therefore an object of the invention to provide heat resistant alloys which have excellent abrasion resistance in the 1200° to 1400° F. (650° to 760° C.) temperature range and good resistance to hot gas corrosion to about 1600° F. (870° C.). It is a further object of the invention to provide such alloys that are air meltable and castable and of relatively low cost for heat resistant alloys. It is a further object of the invention that all of the desired properties may be achieved without the inclusion of aluminum in the alloys, which are very tolerant of tramp elements and impurities but do not introduce aluminum into the foundry scrap and returns However, it is not always possible to completely exclude aluminum from alloys during manufacturing and it has been found that while a truly aluminum-free alloy is preferred up to about 0.2% aluminum can be tolerated without detrimentally changing the properties of the claimed alloys. Nevertheless, for convenience, the alloys of the invention are referred to as aluminum-free alloys.

It is also an object of the invention to provide alloys which may employ molybdenum-containing stainless steel scraps and returns in their formulation to achieve the desired hot hardnesses at operating temperatures.

It is an object of the invention to provide alloys having high resistance to hot gas corrosion and abrasion at low cost at a relatively very low critical or strategic element content.

While a primary object of the invention is to fill the need for aluminum-free lower cost cement cooler grates and similar parts requiring superior resistance to hot abrasion and hot gas corrosion, it is an important object of this invention to provide molydenum-containing alloys which can be economically recycled without all of the problems associated with aluminum-bearing materials.

According to this invention alloys are provided which consist essentially of:

| | |
|---|---|
| CHROMIUM | 11-20% By Weight |
| NICKEL | 3-10.5% |
| MOLYBDENUM | 1-4% |
| CARBON | 2-4.5% |
| NITROGEN | Up to about 0.25% |
| SILICON | 2.7-4% |
| COPPER | Up to about 4% |
| COBALT | Up to about 4% |
| MANGANESE | Up to about 4% |
| ALUMINUM | Up to about 0.2% Maximum |
| COPPER + COBALT | Up to 4% Total |
| COPPER + COBALT + MANGANESE | Up to 8% Total |
| IRON & IMPURITIES | Essentially Balance |
| provided that NICKEL + COPPER + COBALT is | 6-12.5% |
| and further provided that NICKEL + COPPER + COBALT + MANGANESE is | 6-15% |

| | |
|---|---|
| CHROMIUM | 11-20% By Weight |
| NICKEL | 3-10.5% |
| MOLYBDENUM | 1-4% |
| CARBON | 2-4.5% |
| NITROGEN | Up to about 0.25% |
| SILICON | 2.7-4% |
| COPPER | Up to about 4% |
| COBALT | Up to about 4% |
| MANGANESE | Up to about 4% |
| ALUMINUM | Up to about 0.2% Maximum |
| COPPER + COBALT | Up to 4% Total |
| COPPER + COBALT + MANGANESE | Up to 8% Total |
| IRON & IMPURITIES | Essentially Balance |
| provided that NICKEL + COPPER + COBALT is | 6-12.5% |
| and further provided that NICKEL + COPPER + COBALT + MANGANESE is | 6-15% |

DETAILED DESCRIPTION OF THE INVENTION

As discussed above, the present invention is directed toward aluminum-free, relatively low cost heat and abrasion resistant alloys suitable for castings for cement cooler grates and similar industrial installations such as furnaces.

The nickel contents of the alloys of the invention are chosen to provide the proper metallurgical structures in conjunction with the ferrite forming elements chromium, molybdenum and silicon. The desired nickel content may be somewhat reduced by the presence of up to about 4% of the total of copper plus cobalt and up to about 4% manganese, so that the total of copper plus cobalt plus manganese does not exceed 8%. The total content of nickel plus copper plus cobalt should be between 6% and 12.5%, while the nickel plus copper plus cobalt plus manganese should be between 6% and 15%. This is a somewhat higher allowable manganese content than in alloys of the '577 patent, where the total content of nickel, copper and cobalt is limited to about 12.5% maximum.

Higher than about 4% Mn content causes melting and casting problems, such as burn or fusion of sand mold materials. Thus, while manganese may be a partial substitute for nickel in alloys of the invention, it is not required as a deoxidizer because of the very high silicon contents. Therefore manganese may be virtually absent in alloys of the invention without threat of porosity or gas problems. A minimum of at least 3% Ni is required in alloys of the invention. Moreover, if the alloys contain copper and/or cobalt, they must contain a total of at least 6% of nickel, copper and/or cobalt for alloys of less than about 1% Mn content. In the instant alloys manganese above about 1% may be considered as a partial substitute for nickel, copper and/or cobalt on a weight percent equivalency basis. Thus, there must be at least 7% Ni plus manganese present, at least 3% of which is nickel, if copper and/or cobalt is present.

Both silicon and aluminum have strong tendencies to form ferrite. In the '577 patent their total content could be as high as about 4%. In alloys of the present invention, aluminum is absent, and silicon may be as high as about 4% by itself, but a level between about 2.7% and 3.7% is preferred, when other elements are in their preferred ranges.

The alloys of the invention contain at least 11% chromium, and preferably, at least 12% chromium, in order to maintain adequate scaling resistance in the presence of hot corrosive gasses, as well as contributing to the formation of complex carbides and sigma phase, both of which provide high temperature hardness. The relatively high silicon content in alloys of the invention and chromium both act in the role of providing hot gas corrosion resistance and in the formation of sigma phase. However, silicon does not form carbides. A chromium content greater than about 18% and a silicon content greater than about 4% would increase the required nickel content to avoid excessive embrittlement. If chromium exceeds about 18% and/or silicon exceeds about 4% in the presence of the relatively low nickel content of the inventive alloys, hardness may be very high at or near room temperature, but such alloys would become exceedingly brittle at these high carbon levels.

The ranges of component elements in the alloys of the present invention have been developed for carbon levels between 2% and 4.5%, preferably between 3% and 4%, and molybdenum levels between 1% and 4%, preferably 2% to 3%. While carbon tends to form austenite, and molybdenum tends to form ferrite, large amounts of these two elements enter into complex metallic carbides which include some of the chromium present in the alloys. Greater than about 4% Mo or 4.5% C tends to make the alloys excessively brittle.

The presence of greater than about 0.1% boron is very undesirable because boron tends to make the alloy excessively brittle and because it lowers the incipient fusion temperature to undesirably low levels.

While copper has not been found to be absolutely essential to alloys of the invention, it is highly desirable that between about 1% and about 4% copper be present. As will be shown below, both room temperature and high temperature harnesses are somewhat lower when copper is absent or present at levels below about 1%. When greater than about 1% copper is present in the alloys, Brinell Harness Number (BHN) values for hot hardness are increased by at least 20 above those for the copper-free alloys. While this may not appear to be significant at room temperature, the hot hardnesses for copper-bearing alloys at 1300° F. are about 9% to 26% higher than those of the copper-free alloys.

Therefore, for alloys of the invention the preferred ranges of constituent elements are as follows:

| | PREFERRED RANGE |
|---|---|
| CHROMIUM | 11-18% |
| NICKEL | 4-10.5% |
| MOLYBDENUM | 2-3% |
| CARBON | 3-4% |
| NITROGEN | Up to 0.25% |
| SILICON | 2.7-3.7% |
| COPPER | 1-4% |
| COBALT | Up to 3% |
| MANGANESE | Up to 3.5% |
| ALUMINUM | 0.2% Max |
| COPPER + COBALT | Up to 4% |
| COPPER + COBALT + MANGANESE | Up to 8% |
| IRON - IMPURITIES provided that when Manganese is less than about 1% | Essentially Balance |
| NICKEL + COPPER + COBALT is and further provided that when Manganese is greater than about 1% | 6-12.5% |
| NICKEL + COPPER + COBALT + MANGANESE | 8.5-15% |

The following examples further illustrate the invention.

EXAMPLE 1

One hundred pound heats of several different alloys were prepared in accordance with the invention. Chemical analyses of these alloys as well as their hardnesses at room temperature and at 1300° F. (700° C.) are set forth in Table I.

A great deal of industrial foundry experience has shown alloys having hardnesses higher than about 500 BHN present serious cracking problems in the foundry. On the other hand, experience with the alloys of the '577 patent has demonstrated that alloys with hot hardnesses of greater than about 220 BHN at 1300° F. (700° C.). have given excellent outstanding abrasion resistance when used for cement cooler grates. All of the alloys of Table I made in accordance with the invention gave room temperature hardnesses below 500 BHN and hot hardnesses at 1300° F. of 230 BHN or higher. None of the experimental alloys presented any cracking or checking problems when poured into castings. All of the alloys contained less than 0.2% aluminum.

TABLE I

| | | | | | | | | | BHN | |
|---|---|---|---|---|---|---|---|---|---|---|
| No. | C | Si | Ni | Cr | Mo | Mn | Cu | N | RT | 1300° F. |
| CG30 | 3.19 | 3.27 | 4.73 | 11.2 | 2.22 | 3.75 | 1.02 | .04 | 473 | 280 |
| CG31 | 3.15 | 3.85 | 4.08 | 11.3 | 2.72 | 3.66 | 3.76 | .11 | 444 | 250 |
| CG34 | 3.58 | 3.43 | 9.16 | 18.7 | 2.34 | 1.15 | 3.24 | .08 | 460 | 275 |
| CG35 | 3.04 | 3.12 | 8.89 | 15.2 | 2.88 | 2.28 | .06 | — | 420 | 230 |
| CG39 | 3.97 | 2.88 | 8.92 | 14.4 | 3.02 | 2.20 | 2.05 | — | 460 | 280 |
| CG42 | 3.43 | 3.58 | 9.61 | 13.1 | 2.98 | .58 | 2.30 | .19 | 480 | 290 |
| CG44 | 3.72 | 2.79 | 10.21 | 12.3 | 2.08 | 2.37 | 2.35 | .16 | 444 | 250 |
| CG47* | 3.54 | 2.66 | 6.22 | 14.6 | 2.02 | 1.28 | — | .12 | 420 | 230 |

*Alloy CG47 also contains 1.15% Co.

EXAMPLE 2

Alloys prepared in accordance with U.S. Pat. No. 5,106,577 all had magnetic permeability values between 1.05 and 1.4 at room temperature as determined by using a Severn gage. This range of permeability values has been found to be characteristic of cement cooler grate alloys having desirable proportions of carbides, austenite and other phases. Samples of the alloys made up in accordance with the invention were polished, etched and examined under the microscope at powers from 100X to 500X. At these magnifications the microstructures of these alloys appear to be identical to those obtained in alloys prepared in accordance with the '577 patent. Furthermore, all of the alloy samples had magnetic permeabilities between 1.02 and 1.4.

EXAMPLE 3

Test pieces from each of the experimental heats, as well as from several heats made up in accordance with the teachings of the '577 patent, were aged at 1300° F. (700° C.) in a small muffle furnace for periods of 5, 10, 100 and 350 hours. After 5 hours exposure all samples had hardnesses at room temperature between 430 and 480 BHN. After 350 hours all hardness values at room temperature were from 450 to 490 BHN. The alloys of the invention have obviously stabilized at the desired hardness levels.

EXAMPLE 4

It has been reported that the foot members of cement cooler grates made in accordance with U.S. Pat. No. 5,106,577 often break during installation. This problem is probably caused primarily by the brittleness of the grates due to the high carbon content of the alloys.

In general, since alloys containing greater than about 2% carbon do not display measurable elongations during tensile testing two methods of evaluating relative toughness of such alloys have been developed using sand cast test bars of about twenty inches length and 1.2-inch diameter. One method is to use a standard Charpy impact testing machine, but to place the test bars between six-inch supports instead of the usual standard Charpy test bar. The second method of obtaining relative toughness values between such alloys is to employ a transverse test of loading the test bars in the center of an 18-inch span and recording the deflection at breaking.

Two heats were made up in accordance with U.S. Pat. No. 5,106,577 and two heats were made in accordance with the present invention. Each heat was cast into well-risered test bars of 20-inch length and 1.2-inch diameter. Transverse tests were conducted on each of two bars from each heat and deflections were noted in each case. The broken bar halves were then impact tested between six inch supports.

The analyses for the various heats are set forth in Table II below, while the test results are set forth in Table III.

TABLE II

| HEATS ACCORDING TO THE INVENTION | C | Si | Al | Ni | Cr | Mo | Mn | Cu |
|---|---|---|---|---|---|---|---|---|
| A | 3.21 | 3.23 | .04 | 8.83 | 11.6 | 2.44 | 1.16 | — |
| B | 3.38 | 3.14 | .01 | 8.15 | 13.2 | 2.57 | 3.72 | 1.02 |
| HEATS | 3.16 | 2.16 | 1.04 | 8.26 | 12.1 | 2.66 | 1.19 | 1.14 |
| ACCORDING TO 5,106,577 | 3.42 | 1.41 | 1.16 | 8.78 | 12.9 | 2.31 | 3.47 | — |

TABLE III

| HEAT | IMPACT STRENGTH | TRANSVERSE LOAD, LBS. | DEFLECTION INCHES |
|---|---|---|---|
| A | 32, 36 | 3,000 | 0.34 |
| A | 34, 31 | 3,100 | 0.39 |
| B | 42, 37 | 3,600 | 0.38 |
| B | 36, 39 | 3,300 | 0.41 |
| C | 14, 19 | 2,600 | 0.06 |
| C | 16, 20 | 2,400 | 0.14 |
| D | 24, 20 | 2,600 | 0.23 |
| D | 26, 24 | 2,700 | 0.11 |

The surprising and unexpected results of these tests disclose that alloys made up according to the present invention and of less than 0.2% Al content and greater than about 2.7% Si content but otherwise similar in Ni, Cr, Mo, C, Mn and Cu contents to alloys made according to U.S. Pat. No. 5,106,577 with their higher Al and lower Si contents, display toughness and deflections of the order of twice those of such alloys. It thus becomes evident that the alloys of the present invention permit considerbly more margin for error in overtightening the grate foot member T-bolts without installation breakage and at no loss in other alloy properties as compared to the prior art alloys.

The foregoing description of the several embodiments of the invention is not intended as limiting of the invention. As will be apparent to those skilled in the art variations and modifications of the invention may be made without departure from the spirit and scope of this invention.

What is claimed is:

1. An aluminum-free heat resistant alloy having good high temperature hardness, consisting essentially of:

| | |
|---|---|
| CHROMIUM | 11-20% By Weight |
| NICKEL | 3-10.5% |
| MOLYBDENUM | 1-4% |
| CARBON | 2-4.5% |
| NITROGEN | Up to about 0.25% |
| SILICON | 2.7-4% |
| COPPER | Up to about 4% |
| COBALT | Up to about 4% |
| MANGANESE | Up to about 4% |
| ALUMINUM | Up to about 0.2% Maximum |
| COPPER + COBALT | Up to 4% Total |
| COPPER + COBALT + MANGANESE | Up to 8% Total |
| IRON & IMPURITIES | Essentially Balance |
| provided that NICKEL + COPPER + COBALT is | 6-12.5% |
| and further provided that NICKEL + COPPER + COBALT + MANGANESE is | 6-15% |

-continued

| | |
|---|---|
| CHROMIUM | 11-20% By Weight |
| NICKEL | 3-10.5% |
| MOLYBDENUM | 1-4% |
| CARBON | 2-4.5% |
| NITROGEN | Up to about 0.25% |
| SILICON | 2.7-4% |
| COPPER | Up to about 4% |
| COBALT | Up to about 4% |
| MANGANESE | Up to about 4% |
| ALUMINUM | Up to about 0.2% Maximum |
| COPPER + COBALT | Up to 4% Total |
| COPPER + COBALT + MANGANESE | Up to 8% Total |
| IRON & IMPURITIES | Essentially Balance |
| provided that NICKEL + COPPER + COBALT is | 6-12.5% |
| and further provided that NICKEL + COPPER + COBALT + MANGANESE is | 6-15% |

2. An alloy of claim 1 where:

| | |
|---|---|
| CHROMIUM | 11-18% By Weight |
| NICKEL | 4-10.5% |
| MOLYBDENUM | 2-3% |
| CARBON | 3-4% |
| NITROGEN | Up to about 0.25% |
| SILICON | 2.7-3.7% |
| COPPER | 1-4% |
| COBALT | Up to about 3% |
| MANGANESE | Up to about 3.5% |
| ALUMINUM | 0.2% Max |
| COPPER + COBALT | Up to about 4% |
| COPPER + COBALT + MANGANESE | Up to about 8% |
| IRON - IMPURITIES | Essentially Balance |
| provided that when Manganese is less than about 1% NICKEL + COPPER + COBALT is | 6-12.5% |
| and further provided that when Manganese is greater than about 1% NICKEL + COPPER + COBALT + MANGANESE | 8.5-15% |

3. An alloy of claim 2 where copper is 1-4%, copper + cobalt is 1-4%, copper + cobalt + manganese is 1.5-5% + copper + cobalt + manganese is 9.5-13%.

4. An alloy of claim 2 where:

| | |
|---|---|
| CARBON | 3.19% By Weight |
| SILICON | 3.27% |
| NICKEL | 4.73% |
| CHROMIUM | 11.2% |
| MOLYBDENUM | 2.22% |
| MANGANESE | 3.75% |
| COPPER | 1.02% |
| NITROGEN | 0.04% |

5. An alloy of claim 2 wherein:

| | |
|---|---|
| CARBON | 3.97% By Weight |
| SILICON | 2.88% |
| NICKEL | 8.92% |
| CHROMIUM | 14.4% |
| MOLYBDENUM | 3.02% |
| MANGANESE | 2.20% |
| COPPER | 2.05% |

6. An alloy of claim 1 where:

| | |
|---|---|
| CARBON | 3.43% By Weight |
| SILICON | 3.58% |
| NICKEL | 9.61% |
| CHROMIUM | 13.1% |

-continued

| | |
|---|---|
| MOLYBDENUM | 2.98% |
| MANGANESE | .58% |
| COPPER | 2.30% |
| NITROGEN | .19% |

7. An alloy of claim 2 where:

| | |
|---|---|
| CARBON | 3.04% By Weight |
| SILICON | 3.12% |
| NICKEL | 8.89% |
| CHROMIUM | 15.2% |
| MOLYBDENUM | 2.88% |

-continued

| | |
|---|---|
| MANGANESE | 2.28% |
| COPPER | .06% |

8. An alloy of claim 2 where:

| | |
|---|---|
| CARBON | 3.54% By Weight |
| SILICON | 2.66% |
| NICKEL | 6.22% |
| CHROMIUM | 14.6% |
| MOLYBDENUM | 2.02% |
| MANGANESE | 1.28% |
| NITROGEN | .12% |

* * * * *